US007108639B2

(12) United States Patent
Smith et al.

(10) Patent No.: US 7,108,639 B2
(45) Date of Patent: Sep. 19, 2006

(54) ADJUSTABLE ROWING MACHINE

(75) Inventors: Jeffrey A. Smith, Ft. Lauderdale, FL (US); Leao Wang, Taiping (TW)

(73) Assignee: Fitcrew Corp., (TW)

( * ) Notice: Subject to any disclaimer, the term of this patent is extended or adjusted under 35 U.S.C. 154(b) by 159 days.

(21) Appl. No.: 10/887,423

(22) Filed: Jul. 9, 2004

(65) Prior Publication Data

US 2006/0009335 A1 Jan. 12, 2006

(51) Int. Cl.
*A63B 21/00* (2006.01)

(52) U.S. Cl. ..... 482/72; 482/73; 482/51

(58) Field of Classification Search ..... 482/71, 482/70, 52, 51, 62, 66
See application file for complete search history.

(56) References Cited

U.S. PATENT DOCUMENTS 5,527,249 A * 6/1996 Harris ..... 482/96
5,547,444 A * 8/1996 Huang ..... 482/72
5,645,514 A * 7/1997 Chen ..... 482/72
5,707,322 A * 1/1998 Dreissigacker et al. ..... 482/72
6,394,938 B1 * 5/2002 Tornabene ..... 482/142
6,428,450 B1 * 8/2002 Ho et al. ..... 482/140
6,482,133 B1 * 11/2002 Miehlich ..... 482/72

* cited by examiner

*Primary Examiner*—Jerome Donnelly
(74) *Attorney, Agent, or Firm*—Troxell Law Office, PLLC

(57) ABSTRACT

A adjustable rowing machine having a flywheel rewinder coupled by a pull rope with a handgrip for creating a resilience, a supporting frame having a seat movable thereon and a guide device to move along an imaginary circular track, and a base frame. A lifting element is pivotally interposed between the supporting frame and the lifting element for lifting or lowering the supporting frame at a certain angle relative to the base frame so that the exercise position of an operator is changeable.

7 Claims, 4 Drawing Sheets

ADJUSTABLE ROWING MACHINE

BACKGROUND OF THE INVENTION

1. Fields of the Invention

The invention relates to an adjustable rowing machine, and more particularly, to a rowing machine having a lifting device and a guide device for adjusting the angle of a supporting frame relative to a base frame.

2. Description of the Related Art

A rowing machine is a fitness device having a mechanism with two oarlike handles (or a movable bar), foot braces, and a sliding seat, allowing the user to go through reciprocating motions of rowing in a racing shell.

oarlike handles or a movable bar and a sliding seat, used to simulate rowing a racing shell.

U.S. Pat. No. 5,916,069 teaches a rowing exerciser with magnetic resistance having a supporting frame on which a seat moves for supporting the operator's body. This configuration allows the operator to stably sit on the seat to take exercise. However, it lacks the possibility for individual adjustment to weight, height and physical condition of each operator. The reciprocating motion of the rowing machine at a single angle can't meet different requirements of operators any more.

SUMMARY OF THE INVENTION

It is a primary object of the invention is to provide a rowing machine with a function to adjust the sitting angle of the operator during the exercise session.

It is another object of the invention is to provide a rowing machine with a supporting frame to adjust the angle of the supporting frame for positioning the operator's body in an inclined position.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
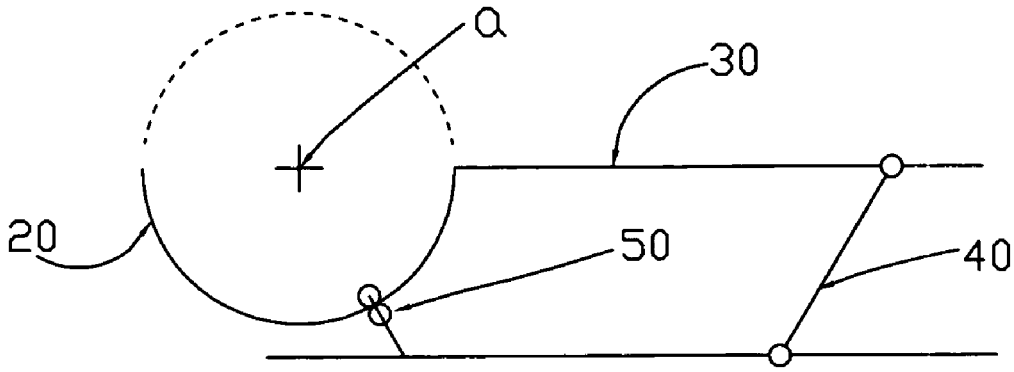
FIG. 1 is a simplified drawing of the invention with dashed line to mark an imaginary circular track of an arched guide device.
Figure 2:
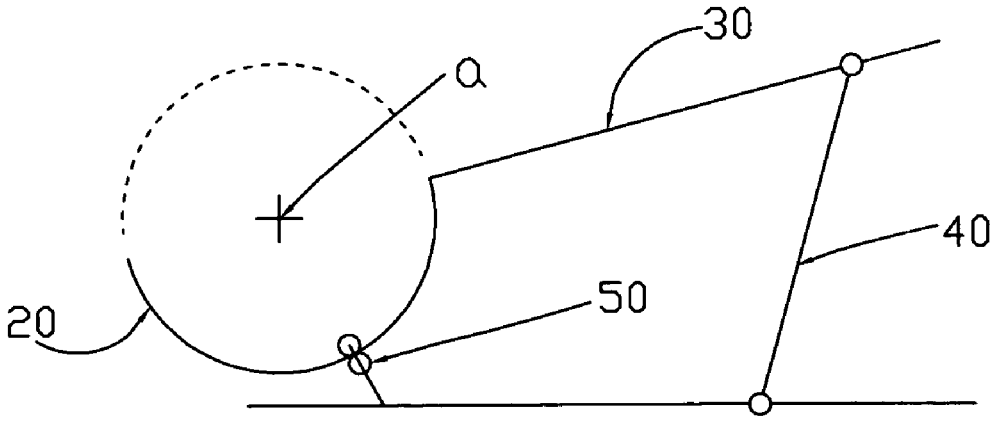
FIG. 2 is a simplified drawing in accordance with the invention, showing a lifting element extended to lift a supporting frame in an inclined position.

Referring to FIGS. 1 and 2, a rowing machine in accordance with the invention includes an arched guide device 20 clamped by rolling elements 50. One end of the arched guide device 20 is connected to a supporting frame 30 that is movably supported by a lifting element 40 in an inclined position.

When the lifting element 40 is extended to lift the supporting frame 30 in an inclined position, the arched guide device 20 moves along an imaginary full circular track (marked with dashed line) having a circular point (a). To the contrary, when the lifting element 40 is retracted to lower the supporting frame 30, the arched guide device 20 also moved along the imaginary full circular track (marked with dashed line) having a circular point (a). In this way, the operator can easily adjust the supporting frame 30 to a desired angle for taking a comfortable exercise session.

Figure 3:
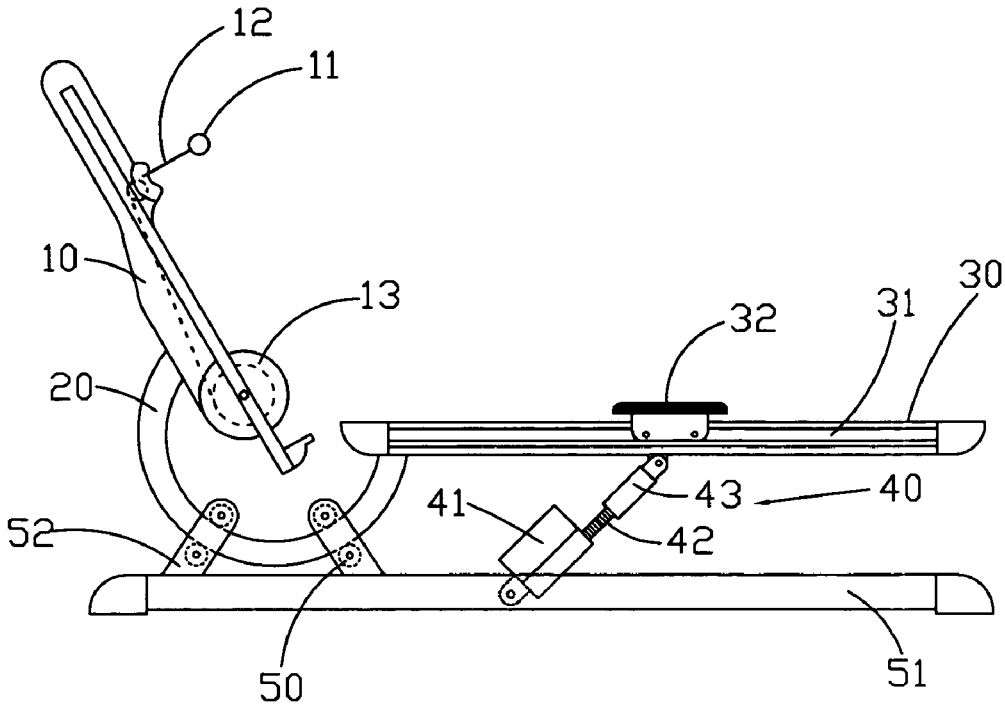
FIG. 3 is a schematic drawing of a first embodiment of the invention wherein the supporting frame is positioned in a horizontal position.
Figure 4:
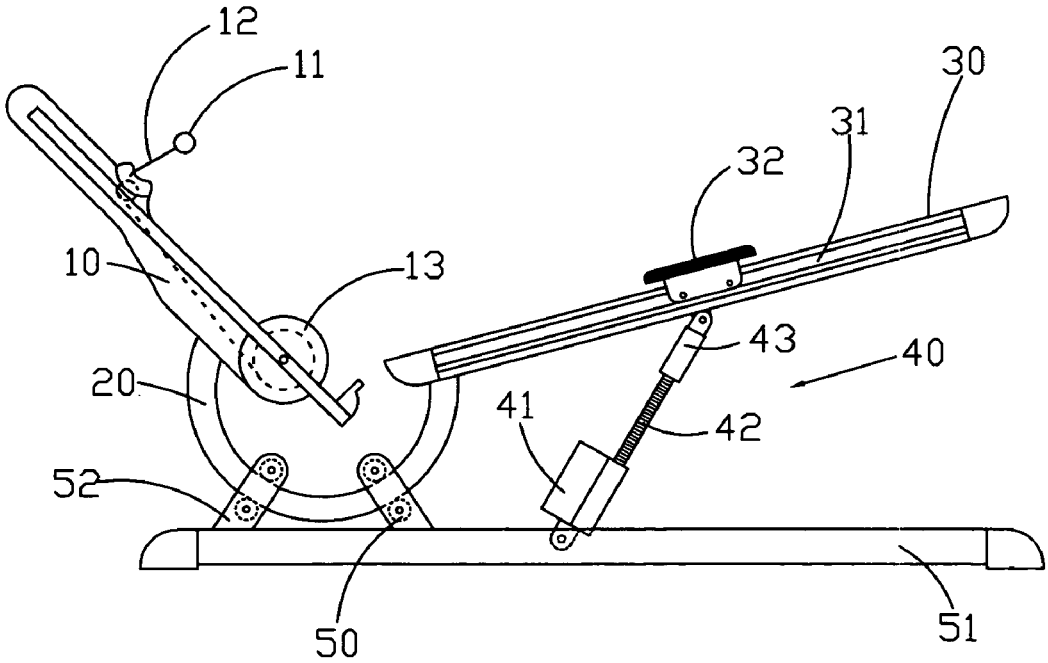
FIG. 4 is a schematic drawing of the first embodiment of the invention wherein the lifting element is extended to lift the supporting frame in an inclined position.

As shown in FIGS. 3 and 4, the adjustable rowing machine in accordance with the invention includes a main frame 10 having a handgrip 11 at the top thereof. The handgrip 11 is connected with a pull rope 12 that passes through a pulley (marked with dashed line) within the main frame 10 and is secured to a flywheel rewinder 13. When the handgrip 11 pulls the pull rope 12 to extend its length, the flywheel rewinder 13 will be simultaneously turned to accumulate its resilience. When the handgrip 11 is released, the pull rope 12 will be rewound around the flywheel rewinder 13 by its accumulated resilience and the handgrip 11 moving with the pull rope 12 will return to its original position.

The main frame 10 is connected to a first end of the arched guide device 20 while a second end thereof and the supporting frame 30 are integrally joined. The arched guide device 20 is clamped by the rolling elements 50 of the upright support 52 of the base frame 51. Moreover, the lifting element 40 is pivotably interposed between the base frame 51 and the supporting frame 30.

Furthermore, the supporting frame 30 includes rails 31 for a seat 32 to perform a reciprocating movement thereon. Meanwhile, the supporting frame 30 is supported by the lifting element 40 and maintained at a certain angle or in a horizontal position. The lifting device 40 can includes an electric motor 41 that drives a socket 43 screwed on a spindle 42 to undergo a reciprocating motion in axial direction.

When the socket 43 on the spindle 42 is extended by the electric motor 41 to lift the supporting frame 30, the arched guide device 20 clamped by the rolling element 50 is movable with the supporting frame 30 along an imaginary circular track until the lifting element 40 is stopped. At that time, the supporting frame 30 is positioned at a certain angle to allow the operator to take exercise sessions.

To the contrary, when the socket 43 on the spindle 42 is retracted by the electric motor 41 to lower the supporting frame 30, the arched guide device 20 clamped by the rolling element 50 is movable with the supporting frame 30 along an imaginary circular track until the lifting element 40 is stopped. So, the supporting frame 30 is positioned at a certain angle or returns to its original position for next operators to undergo the angle-adjusting action.

Figure 5:
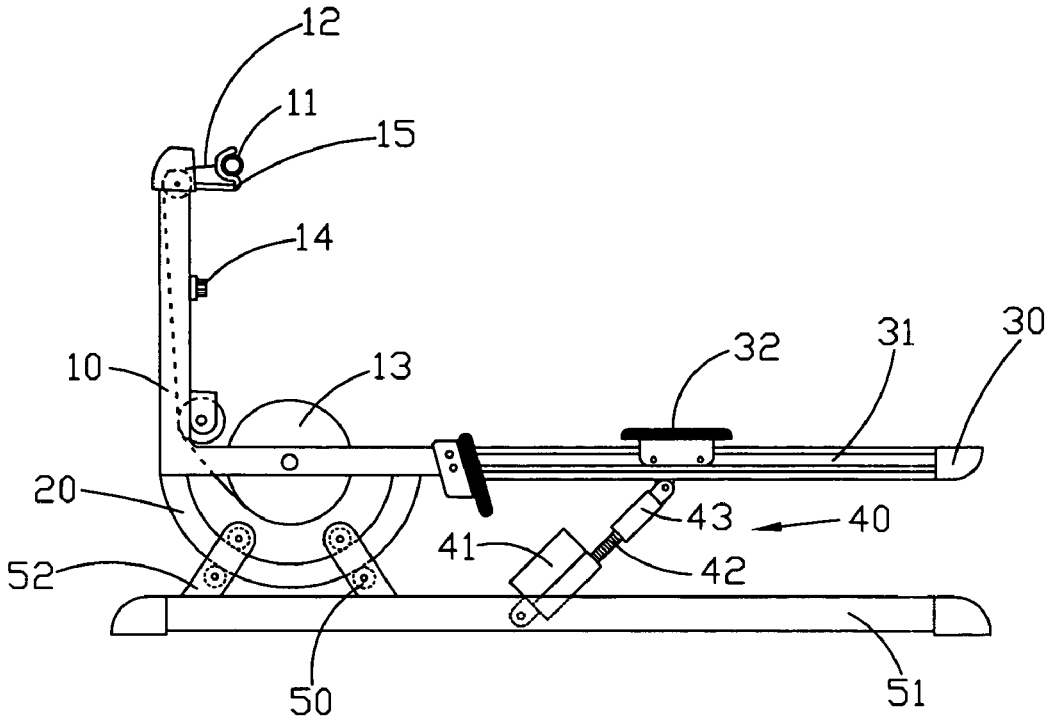
FIG. 5 is a schematic drawing of a second embodiment of the invention wherein the supporting frame is positioned in a horizontal position.
Figure 6:
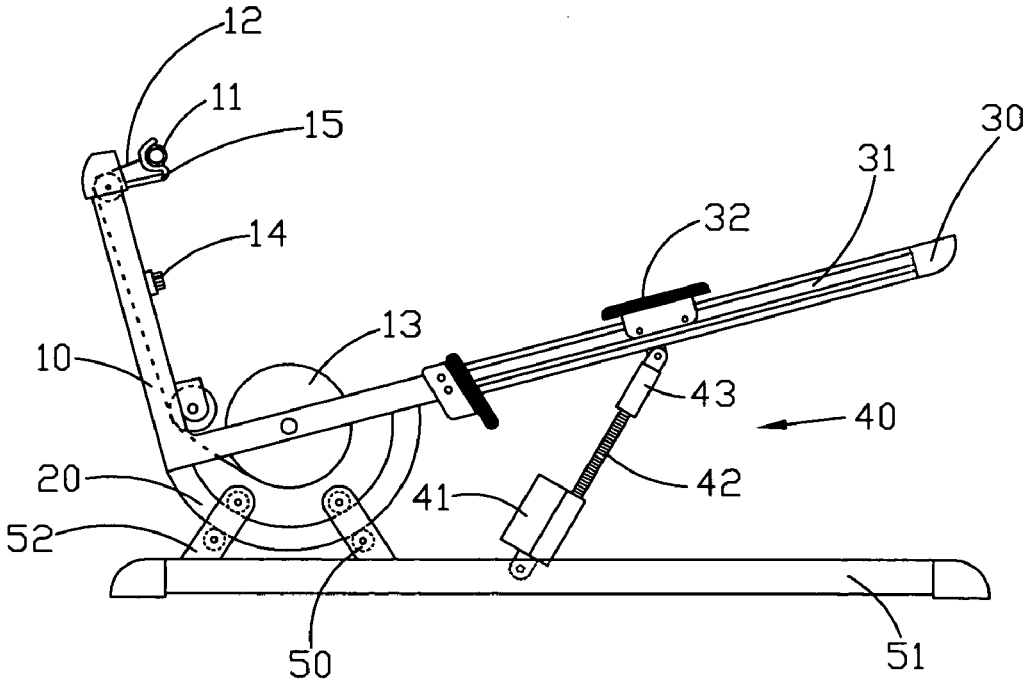
FIG. 6 is a schematic drawing of the second embodiment of the invention wherein the lifting element is extended to lift the supporting frame in an inclined position.

Referring to FIGS. 5 and 6, an adjustable rowing machine in accordance with another embodiment of the invention includes a main frame 10 with a control knob 14. A stop rod 15 is provided at the top of the main frame 10 for limiting the motion of a handgrip 11 in connection with a pull rope 12. A supporting frame 30 having a flywheel rewinder 13 mounted on one side thereof is integrally joined to the main frame 10. The pull rope 12 passes through a pulley (marked with dashed line) within the main frame 10 and is wounded around the flywheel rewinder 13. When the pull rope pull rope 12 is pulled by the handgrip 11 and extended over a certain length, the flywheel rewinder 13 accumulates its resilience. Thereafter, the pull rope 12 will be rewound around the flywheel rewinder 13 again by the resilience accumulated by the flywheel rewinder 13 when the handgrip 11 is released to return to the stop rod 15.

Moreover, the supporting frame 30 includes rails 31 for a seat 32 to perform a reciprocating movement. In addition, the supporting frame 30 is integrally connected with the arched guide device 20. The arched guide device 20 is clamped by the rolling element 50 of the upright support 52 of the base frame 51. Moreover, the lifting element 40 is pivotably interposed between the base frame 51 and the supporting frame 30. Meanwhile, the supporting frame 30 is supported by the lifting element 40 and maintained at a certain angle or in a horizontal position. The lifting device 40 may include an electric motor 41 that drives a socket 43 screwed on a spindle 42 to undergo a reciprocating motion in axial direction.

In use, the electric motor 41 is activated to drive the socket 43 on the spindle 42 to extend over a certain length, thereby lifting the supporting frame 30 in an inclined position. Meanwhile, the arched guide device 20 clamped by the rolling element 50 is movable with the supporting frame 30 along an imaginary circular track until the lifting element 40 is stopped. At that time, the supporting frame 30 is positioned at a certain angle to allow the operator to take exercise sessions.

To the contrary, when the socket 43 on the spindle 42 is retracted by the electric motor 41 to lower the supporting frame 30, the arched guide device 20 clamped by the rolling element 50 is movable with the supporting frame 30 along an imaginary circular track until the lifting element 40 is stopped. So, the supporting frame 30 is positioned at a certain angle or returns to its original position for next operators to undergo the angle-adjusting action.

Based on the aforementioned configuration, when the supporting frame 30 is lifted in such an inclined position that the operator sitting on the seat 32 can overlook the ground. To the contrary, the supporting frame 30 can be pulled back by the lifting device 50 in such an inclined position that the operator sitting on the seat 32 can look up to the sky.

Figure 7:
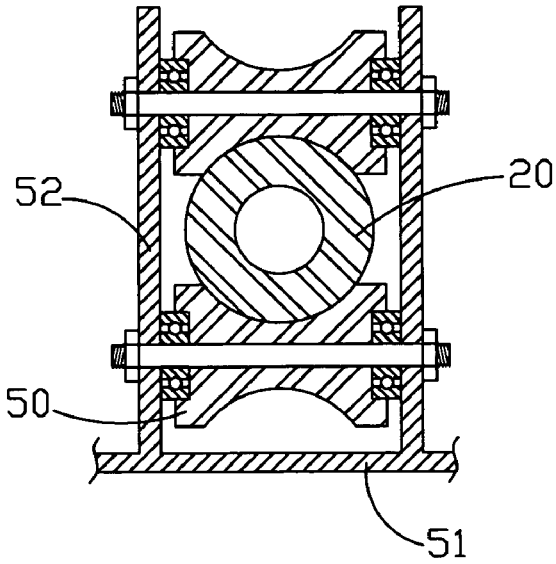
FIG. 7 is a cutaway view of a first embodiment of a guide device clamped by rolling elements.
Figure 8:
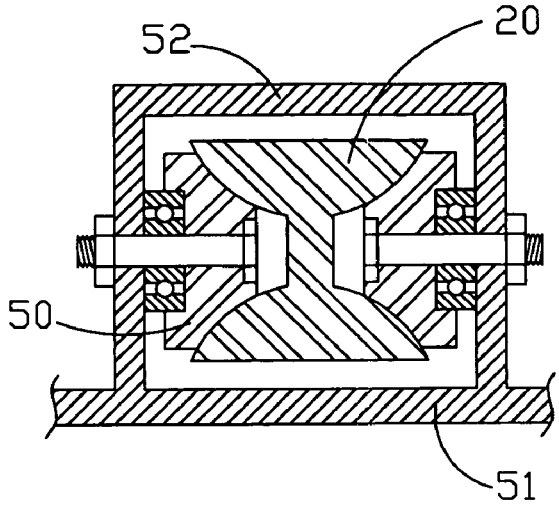
FIG. 8 is a cutaway view of a second embodiment of a guide device clamped by rolling elements.
Figure 9:
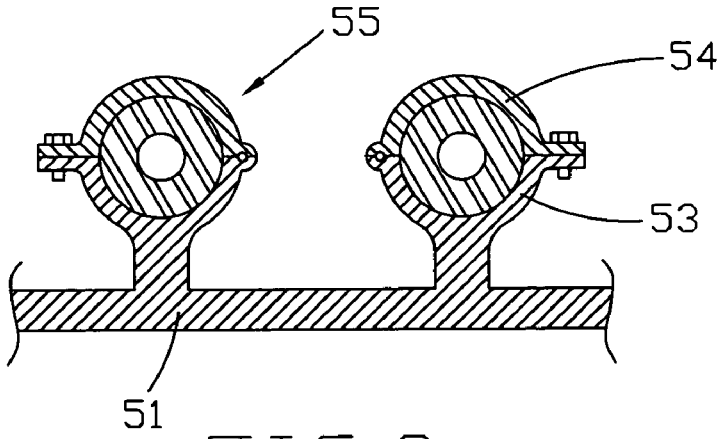
FIG. 9 is a cutaway view of a third embodiment of a guide device clamped by clamping element.

FIGS. 7 through 9 shows how the guide device is clamped. As shown in FIG. 7, the guide device 20 is constructed as an arched tube and its circumference is clamped by two rolling elements 50 pivotally connected to the upright support 52 of the rolling element 50. When the guide device 20 moves with the supporting frame 30 along the imaginary circular track, it's rollable for displacement between two rolling elements 50. As shown in FIG. 8, the guide device 20 has a cross-section of hourglass whose middle narrow part is clamped by two rolling elements 50 pivotally connected to the upright support 52 of the rolling element 50. When the guide device 20 moves with the supporting frame 30 along the imaginary circular track, it's rollable for displacement between two rolling elements 50. As shown in FIG. 9, the guide device 20 is constructed as an arched tube and its circumference is clamped by a clamping element 55 consisting of a bottom cover 53 fastened on the base frame 51 and a movable top cover 54. When the guide device 20 moves with the supporting frame 30 along the imaginary circular track, it's rollable for displacement between two clamping elements 55.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An adjustable rowing machine comprising:

a) a main frame having a flywheel rewinder connected to a pull rope with a handgrip and creating a resilience;

b) a supporting frame movable between the horizontal and inclined positions and having a seat slidably located thereon;

c) an arched guide device having a first end connected to the main frame and a second end connected to the supporting frame;

d) a base frame;

e) a lifting element having a first end pivotally connected to the supporting frame and a second end pivotally connected to the base frame, the lifting element selectively positioning the supporting frame between the horizontal and inclined positions; and f) two positioning elements connected to the base frame, the arched guide device is inserted through each of the two positioning elements and movable is moved along a circular path.

2. The adjustable rowing machine according to claim 1, wherein the supporting frame includes rails, and the seat is slidably located on the rails.

3. The adjustable rowing machine according to claim 1, wherein the lifting element having:

a) an electric motor;

b) a spindle connected at an end thereof to the electric motor; and c) a socket, the spindle is threadedly connected to the socket, the electric motor controlling a rotation of the spindle and selectively moving the supporting frame between the horizontal and inclined positions by moving the socket along a length of the spindle.

4. The adjustable rowing machine according to claim 1, wherein each of the two positioning elements is a rolling element.

5. The adjustable rowing machine according to claim 4, wherein each rolling element is connected to the base frame by an upright support.

6. The adjustable rowing machine according to claim 1, wherein each of the two positioning elements is a clamping element having a bottom cover and a top cover located around an exterior periphery of the arched guide device.

7. The adjustable rowing machine according to claim 1, wherein the arched guide device has a cross section having a hour glass shape.

* * * * *